US009062930B1

(12) United States Patent
Burke et al.

(10) Patent No.: US 9,062,930 B1
(45) Date of Patent: Jun. 23, 2015

(54) VARIABLE MUNITIONS DEPLOYING FLASHLIGHT DEVICE

(71) Applicant: Hi-Beam Dynamics Corporation, Surrey (CA)

(72) Inventors: Sharlynne Burke, Surrey (CA); Jonathan Faille, Gibsons (CA)

(73) Assignee: Hi-Beam Dynamics Corporation, Surrey (CA)

( * ) Notice: Subject to any disclaimer, the term of this patent is extended or adjusted under 35 U.S.C. 154(b) by 0 days.

(21) Appl. No.: 14/506,949

(22) Filed: Oct. 6, 2014

(51) Int. Cl.

| | |
|---|---|
| ***F41A 19/00*** | (2006.01) |
| ***F41C 9/00*** | (2006.01) |
| ***F42B 12/46*** | (2006.01) |
| ***F42B 12/56*** | (2006.01) |
| *F41C 9/02* | (2006.01) |

(52) U.S. Cl.
CPC . *F41C 9/00* (2013.01); *F42B 12/46* (2013.01); *F42B 12/56* (2013.01)

(58) Field of Classification Search
CPC ..... F41G 1/35; F41G 1/00; F41G 1/34; F41G 3/2655; F41G 1/473; F41G 3/2616; F21L 4/00; F21L 4/027; F41C 33/00; F41C 33/001; F41C 9/02; F41C 23/12; F41C 33/048; F41C 23/22; F41C 27/00; F41A 19/22; F41A 19/52; F41A 19/10; F41A 21/00; F41A 21/12; F41A 21/32; F41A 19/07; F41H 13/0087; F41H 11/00; F41H 13/00; F41H 9/10; A41D 19/01594; A41D 19/0024; F21Y 2101/02; Y10S 224/912; F41B 11/70; B29K 2705/00; B29L 2031/777
USPC ..... 42/69.01, 146, 1.16, 52, 1.11, 1.09; 362/110–114
See application file for complete search history.

(56) References Cited

U.S. PATENT DOCUMENTS

| | | | | |
|---|---|---|---|---|
| 1,173,464 | A * | 2/1916 | Rogers | 42/53 |
| 1,461,600 | A * | 7/1923 | Cottrell | 42/146 |
| 1,726,228 | A * | 8/1929 | Juhasz | 42/1.11 |
| 2,625,764 | A * | 1/1953 | O'Brien et al. | 42/146 |
| 3,526,972 | A * | 9/1970 | Sumpf | 434/22 |
| 4,481,561 | A * | 11/1984 | Lanning | 362/111 |
| 8,510,982 | B1 * | 8/2013 | Squires | 42/146 |
| 8,584,392 | B1 * | 11/2013 | Young | 42/114 |

* cited by examiner

*Primary Examiner* — Troy Chambers
*Assistant Examiner* — Bridget Cochran
(74) *Attorney, Agent, or Firm* — John R Flanagan

(57) ABSTRACT

A combined flashlight and munition deploying device in which light sources are arranged around a munition-loadable crown of the device so that illumination is emitted in the same direction that the munition is deployed. The flashlight may be operated in a strobe mode. A common trigger is used to first operate the strobe and then to fire the munition. A toggle mechanism serves to cock the firing pin as the crown is being opened for loading a cartridge. An extendable battery compartment may be included, which also serves as an extendable handle. The device may be configured for many different types of less-than-lethal munitions.

18 Claims, 4 Drawing Sheets

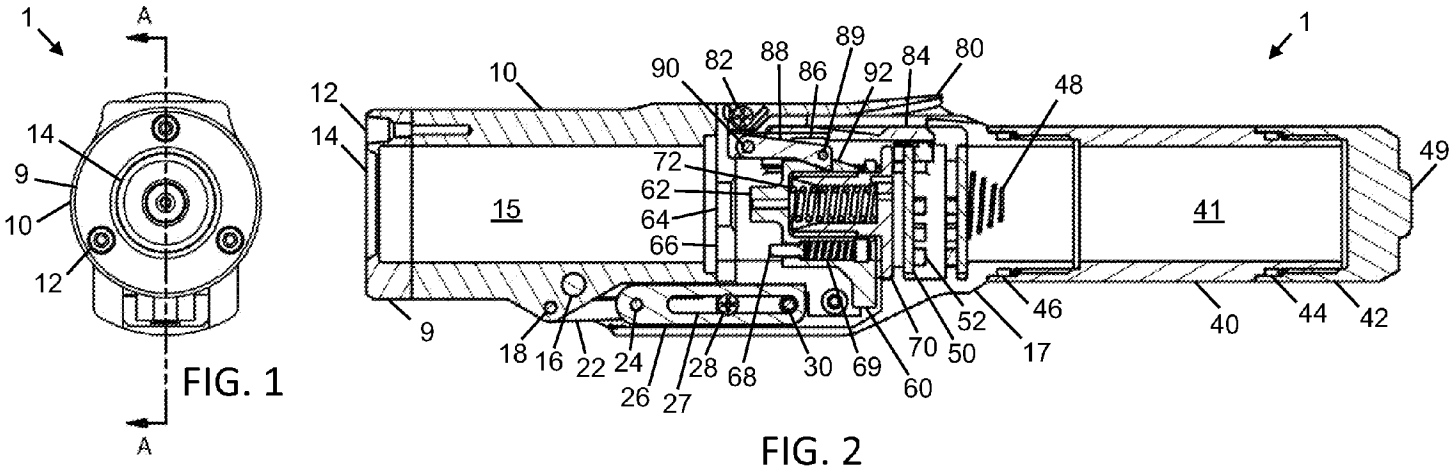
FIG. 2
FIG. 1
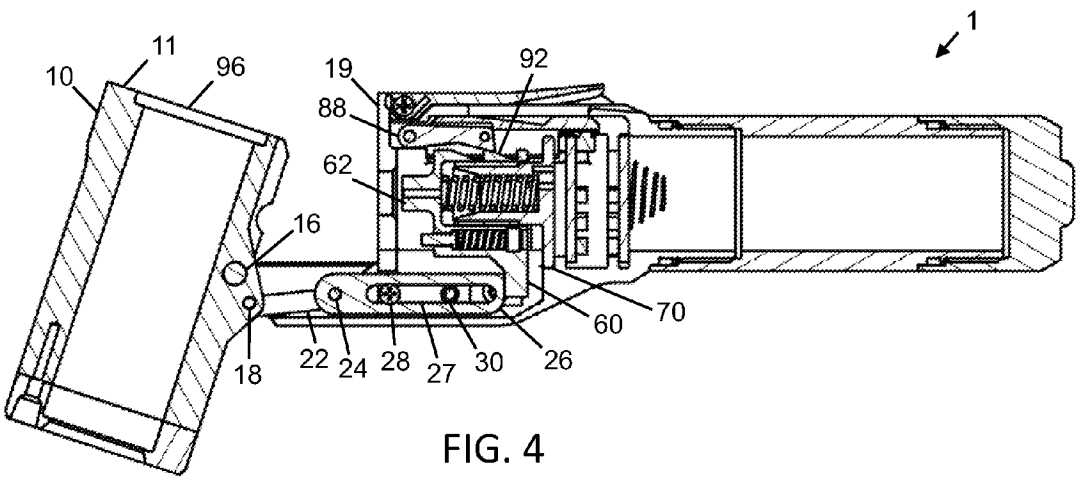
FIG. 4
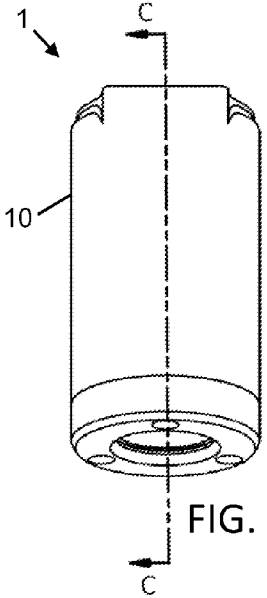
FIG. 3

VARIABLE MUNITIONS DEPLOYING FLASHLIGHT DEVICE

TECHNICAL FIELD

The present invention generally relates to a flashlight device that integrates the capability of safely housing and discharging a variety of munitions.

BACKGROUND

Individuals working or playing in uninhabited outdoor environments, for example when camping, almost always carry a flashlight with them as standard gear. However, those who require safety devices such as flares, animal deterrents or fire starters, must pack or carry these as additional equipment. Not having these devices on hand and accessible at a moment's notice can worsen a dangerous scenario, especially in the event of a bear or other animal attack.

For self-defense and other security applications, individuals who wish or need to carry a non-lethal protection device on themselves have a limited number of options available to them. Pepper spray is one of the most popular options available, and can be carried in aerosol canisters or spray discharge flashlights, as well as in other devices. A drawback with pepper spray deployment is that it has little intimidation effect on a would-be assailant, having now been in use for so many years. There are also flashlight devices that have strobe functions to serve as an initial warning or defensive measure, but they all require the user to press an activation button a number of times in order to deploy the strobe light.

Almost all enforcement and military agencies world-wide equip their personnel with a variety of less-than-lethal devices. Devices that shoot tear gas and pepper spray are commonly used, although far more popular is the use of loaded-down or less-than-lethal 12 gauge shotgun shells. These munitions are essentially standard shotgun shells that contain less gunpowder than normal, and are loaded with projectiles such as rubber bullets or beanbags. The effect of these less-than-lethal shells is to knock an individual down without being lethal. The problem, however, is that deploying these highly-effective rounds requires the use of an actual, full-size shotgun. In many cases, agencies deploying less-than-lethal 12 gauge rounds must equip their personnel with shotguns that have been colorized to distinguish them as special equipment, so as not to confuse them with shotguns carrying lethal rounds. Since regular shotguns can deploy both lethal and less-than-lethal rounds, making a mistake by mixing ammunition can have fatal consequences.

Almost all SWAT (Special Weapons and Tactics) and military teams carry what is known as a 'master key', which is essentially a cut-down shotgun that is mounted under a standard-issue battle rifle (e.g. an M4). Loaded with 12 gauge buckshot rounds, a master key is highly effective in blowing locked doors open. The problem is that mounting a cut-down shotgun under a rifle is expensive, heavy and cumbersome to carry.

SUMMARY OF INVENTION

The present invention is an LED (Light Emitting Diode) flashlight device that can discharge a variety of munitions. In various embodiments, the device can chamber and discharge signal flares, animal deterrents, paintball and pepper ball air cartridges, and many firearm 12 gauge munitions. The munitions deploying flashlight device has a multitude of applications, which include, for example, camping, marine safety, animal deterrence, self-defence, paintball gaming, security, law enforcement, corrections and military.

The device has a unique, pivoting crown that allows munitions to be chambered with the device in a forward position, allowing the user to be able to point the device as a flashlight and deploy the munition without altering the device's position. The device also has a unique toggle mechanism, which cocks or arms the firing system when the crown is fully opened, and which requires very little force to do so. The device may also incorporate a strobe light function and may have a unique trigger mechanism, which allows the user to instantly activate the strobe in one on position and discharge the munition in another on position.

Disclosed herein is a munition deploying flashlight device comprising: a body having a front portion and a rear portion; a firing pin housed in the body; a crown having a chamber for loading a munition therein, wherein said crown is: attached via a pivot to the front portion of the body; and rotatable from an open position that exposes an opening in the crown through which the munition is loaded to a closed position that aligns the loaded munition with the firing pin; a toggle that is mechanically actuated by the crown to cock the firing pin as the crown is rotated to its open position; one or more light sources mounted in the crown; and a trigger having an off position, a first on position that causes the light sources to strobe and a second on position that causes the firing pin to discharge the munition.

Also disclosed herein is a method of deploying a munition deploying flashlight device comprising: rotating a crown of the device to an open position, to mechanically actuate a toggle to cock a firing pin of the device; loading a munition into a chamber of the crown; rotating the crown to a closed position to align the munition with the firing pin; moving a trigger in the device from an off position to a first on position to illuminate a strobe in the device; and moving the trigger from the first on position to a second on position to discharge the munition in a direction in which the strobe is aimed. Moving the trigger may comprise sliding it from the off position to the first on position and then from the first on position to the second on position.

BRIEF DESCRIPTION OF THE DRAWINGS

The following drawings illustrate embodiments of the invention, and should not be construed as restricting the scope of the invention in any way.

FIG. 1 is an end view of an exemplary embodiment of a munition deploying flashlight device in accordance with the present invention showing a crown and a plurality of LEDs of the device.

FIG. 2 is a side sectional view taken along section A-A of FIG. 1, showing the device with a trigger position off and a firing pin cocked.

FIG. 3 is an end view of the device showing the crown in an open position.

FIG. 4 is a side sectional view taken along section C-C of FIG. 3, showing the device with the trigger position off and the firing pin being cocked.

DETAILED DESCRIPTION

Figure 5:
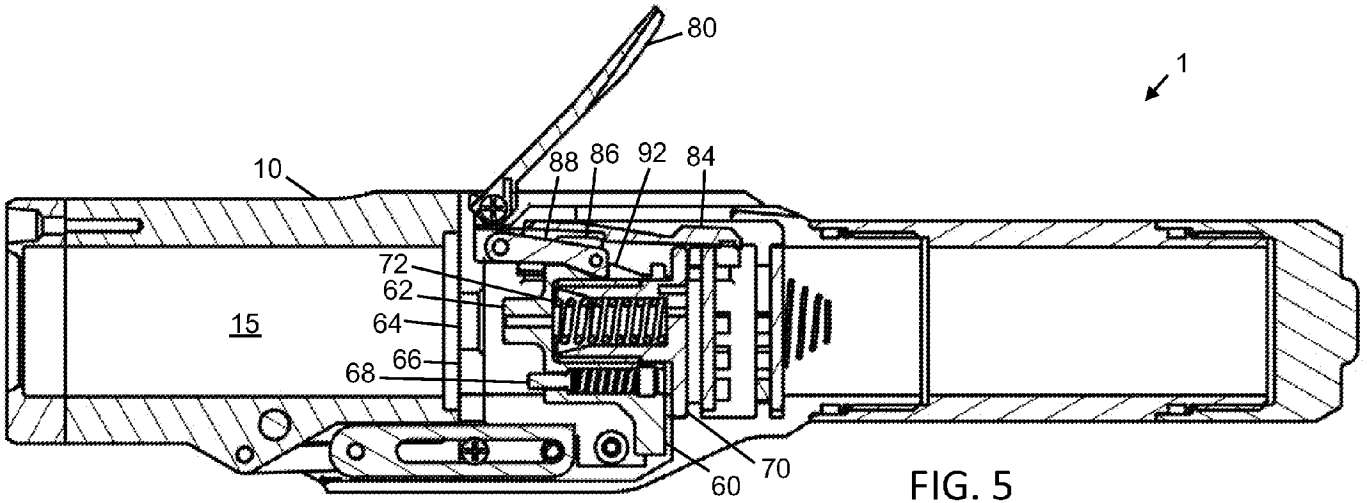
FIG. 5 is a side sectional view showing the device with the trigger position set to strobe and the firing pin cocked.

Forwards and backwards are terms used to describe movements of various parts of the device, where forwards refers to the pointing direction of the device and the direction in which the munitions are fired. Outwards or outer refers to a direction away from the center line of the device, and inner or inwards refer to a direction towards the center line of the device.

Referring to FIGS. 1 and 2, an exemplary embodiment of a munition deploying flashlight device, generally designated 1, is shown having a crown 10 (or barrel) with a front end 9 (muzzle), a plurality of LEDs 12 (light emitting diodes) mounted in the crown 10 and exposed at the front end 9 thereof, and an aperture 14 defined in the front end 9 of the crown 10 through which a munition (not shown) exits the crown when fired. The LEDs 12 emit light in the forward direction of the device 1, aimed in a narrow or wide cone of light, generally centered in the same direction as the munition is discharged. The LEDs 12 are equally spaced and arranged around the aperture 14 in a halo or ring configuration, but other layouts and mounting positions are possible in other embodiments. While three LEDs have been shown, other embodiments may have other quantities of LEDs, such as 1, 2, 4 or more. Light sources other than LEDs may be used, such as incandescent lights or laser diodes.

More particularly, the crown 10 encloses an interior chamber 15 into which a cartridge or other munition can be loaded. The crown 10 is attached via a crown pivot 16 to a bottom part of a body 17 of the device 1. The crown 10 rotates about the crown pivot 16, permitting the crown to open and close for emptying spent cartridges and loading fresh ones. As the crown 10 is opened, it actuates a toggle mechanism for cocking the device 1. The toggle mechanism includes a pivot 18 on the crown 10, to which an arm 22 is connected. The arm 22 is connected in turn via pivot 24 to toggle 26 having a slot 27. The toggle 26 is guided with pins 28, 30 protruding into or through the slot 27 so that the toggle slides back and forth (respectively right and left in the figure) as the crown 10 is opened and closed. Cocking will be further explained below, with respect to FIG. 4. When the crown 10 is closed, a locking button (not shown) is used to retain the toggle 26 in position, which in turn retains the crown in a closed position with its rear face 11 (FIG. 4) flush with a forwards facing face 19 (FIG. 4) of the body 17. There are several different ways in which the toggle 26 may be locked.

Also connected to the body 17 is a battery holder 40 that defines an interior compartment 41 for one or more batteries. The battery holder 40 is closed off by an end cap 42, which screws or clips onto the outer end of the holder 40. Likewise, the battery holder 40 screws or clips onto the back end of the body 17 of the device. The connections between the body 17, the holder 40 and the end cap 42 may be sealed from moisture by o-rings in cavities 44, 46. Other sealing techniques may be used in alternate embodiments. The modular construction of the battery compartment allows different lengths of holder 40 to be used, or additional sections to be added, so that batteries of different storage capacity may be used. For example, an extension tube may be supplied with the device so that single or dual batteries can be used. Different lengths may be preferable, depending on what the device is being used for, and also as the battery holder 40 serves as a handle for the device. Also shown is spring connector 48 for making an electrical connection to the battery. The other connection from the battery may be via the end cap, which may include a switch 49 for regular flashlight operation. A frame type battery holder with one or two integral connections may also be used inside the compartment 41. In some embodiments, the other electrical connection may be via the end cap 42 and wall of the battery compartment 40 if they are made from an electrically conductive material such as aluminum. Many different arrangements are possible for connecting the battery. Power from the battery is directed to the circuit board 50, on which are mounted various components 52 for driving the LEDs 12. Wiring from the circuit board is fed to the LEDs 12 using a copper detent pin. In other embodiments, other ways of feeding the wiring to the LEDs can be used.

A firing pin body 60 is integral with a firing pin 62. Aligned with the firing pin 62 is an opening 64 in a split stop plate 66, though which the firing pin protrudes during firing. When the crown 10 is closed, the munition in the chamber 15 of the crown is aligned with the firing pin 62. Within the firing pin body 60 is a return pin 68, biased forwards out of the firing pin body by return spring 69. The return pin 68 serves to push the firing pin 62 back from the stop plate 66 so that it no longer protrudes through the opening 64 after firing. The firing pin body 60 is mounted so that is can slide in and out over a firing pin support base 70. Firing spring 72 within the base 70 is compressed when the firing pin 62 is cocked, and pushes the firing pin forwards through the stop plate 66 when the firing pin is triggered.

A safety flap 80, connected to the body 17 of the device at pivot 82, covers a thumb operated sliding trigger 84, shown here in its off position. Note that the trigger 84 is on the top of the device, on the opposite side of the body 17 to the crown pivot 16, which permits the device 1 to be held in the same orientation for loading as for operating the light and deploying the munition. In other embodiments, the trigger 84 could be placed elsewhere on the device. It could be incorporated in the crown 10 of the device 1, for example.

The trigger 84 is biased forwards towards its off position by a spring (not shown). As shown, the flap 80 is closed, but when it is opened it exposes the thumb operated trigger 84 to a user. A ramp 86 (better seen in FIGS. 6, 7) is integral to the trigger 84 and slides back and forth with it. The lower, inclined surface 98 (FIG. 6, 7) or edge of the ramp engages with a pawl 88, which has a guide pin 89 that is biased inwards by a spring onto the inclined surface of the ramp. When the trigger 84 is pulled back, the ramp moves with it and forces the guide pin 89 outwards, causing the pawl 88 to rotate outwards away from the firing pin body 60. The pawl rotates about pivot 90 and is biased inwards with a spring (not shown). As such, the pawl 88 can be moved off and outwards from the ramp against its spring force, but it is prevented from moving further inwards because the inclined surface 98 of the ramp 86 blocks it. As the pawl 88 is rotated away from the firing pin body 60, it disengages from the forward surface of the sear tooth 92 on the outside of the firing pin body, allowing forward motion of the firing pin body 60 and connected or integral firing pin 62.

Referring now to FIGS. 3 and 4, the device 1 is shown with the crown 10 in an open position, so that a cartridge can be inserted or loaded through an opening 96 at the rear end of the crown 10. The crown 10 is in the process of being opened to cock the firing pin 62. As the crown 10 is opened, it pivots about crown pivot 16, pushing arm 22 and toggle 26 backwards with respect to the body 17 of the device 1. The toggle 26 slides along the direction of its slot 27 by being guided by pins 28, 30. Pivots 18, 24 allow the rotational motion of the crown to be converted into sliding action of the toggle 26. As the toggle 26 is slid backwards, it pushes against a forward facing surface of the firing pin body 60, which in turn is pushed backwards. As the firing pin body 60 reaches the firing pin support base 70, the pawl 88 clicks over the sear tooth 92 and springs towards the firing pin body 60, retaining it in the cocked position. Due to the mechanical advantage of the toggle mechanism, very little force is needed to cock the device. After the firing pin 62 has been cocked, the crown 10 can be loaded with a cartridge and closed, resulting in the toggle 26 moving forwards, away from the firing pin body 60 to the position shown in FIG. 2.

FIG. 5 shows the device 1 with the crown 10 closed, the safety flap 80 open, the trigger 84 set to "strobe" and the firing pin 62 cocked. The trigger 84 is depressed slightly in its strobe setting in order to actuate an electrical switch to switch on the strobe. The firing pin body 60 is in a backwards position, compressing the firing spring 72 in the firing pin support base 70. The pawl 88 is engaged, by being sprung inwards, onto the forward surface of the sear tooth 92, which locks the firing pin body 60 back.

Figure 6:
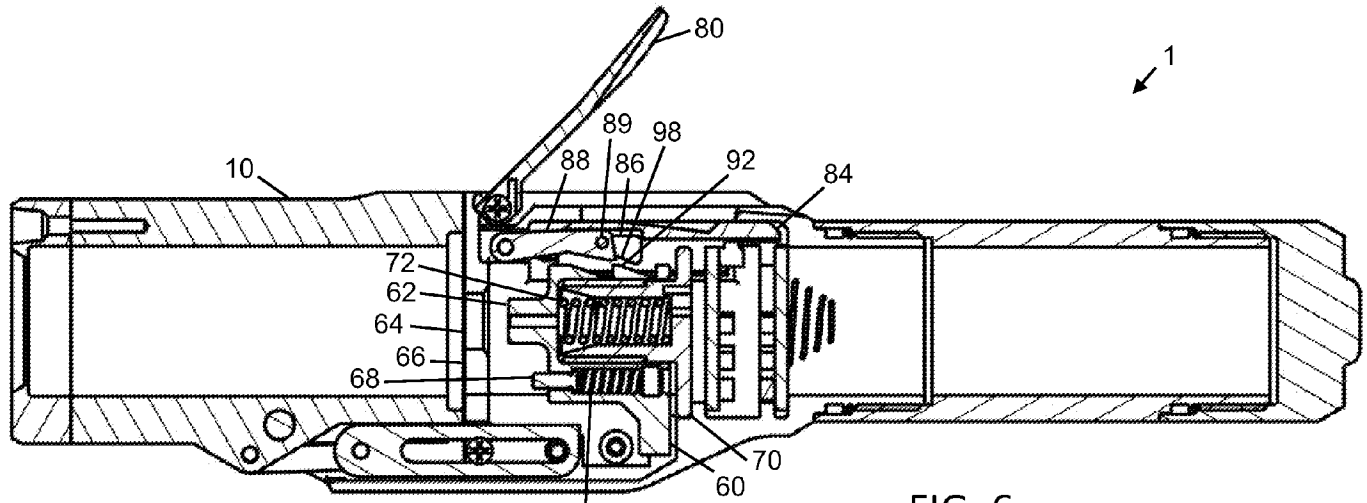
FIG. 6 is a side sectional view showing the device with the trigger position set to fire and the firing pin at the moment of fire.

FIG. 6 shows the device 1 with the trigger 84 in the fire position and the device at the moment of fire. The crown 10 is closed, the safety flap 80 open and the trigger 84 with its ramp 86 have been pulled back. The pawl 88 has been forced out and away from the sear tooth 92 by the motion of the ramp 86 acting on the pawl's guide pin 89. At this moment, the firing spring 72 is still compressed but not restrained, and is about to impart its potential energy to the firing pin body 60, to rapidly push it away from the firing pin base 70 and push the firing pin 62 through the opening 64 in the stop plate 66. At this moment, the return pin 68 is in its rest position and the return spring 69 is not compressed.

Figure 7:
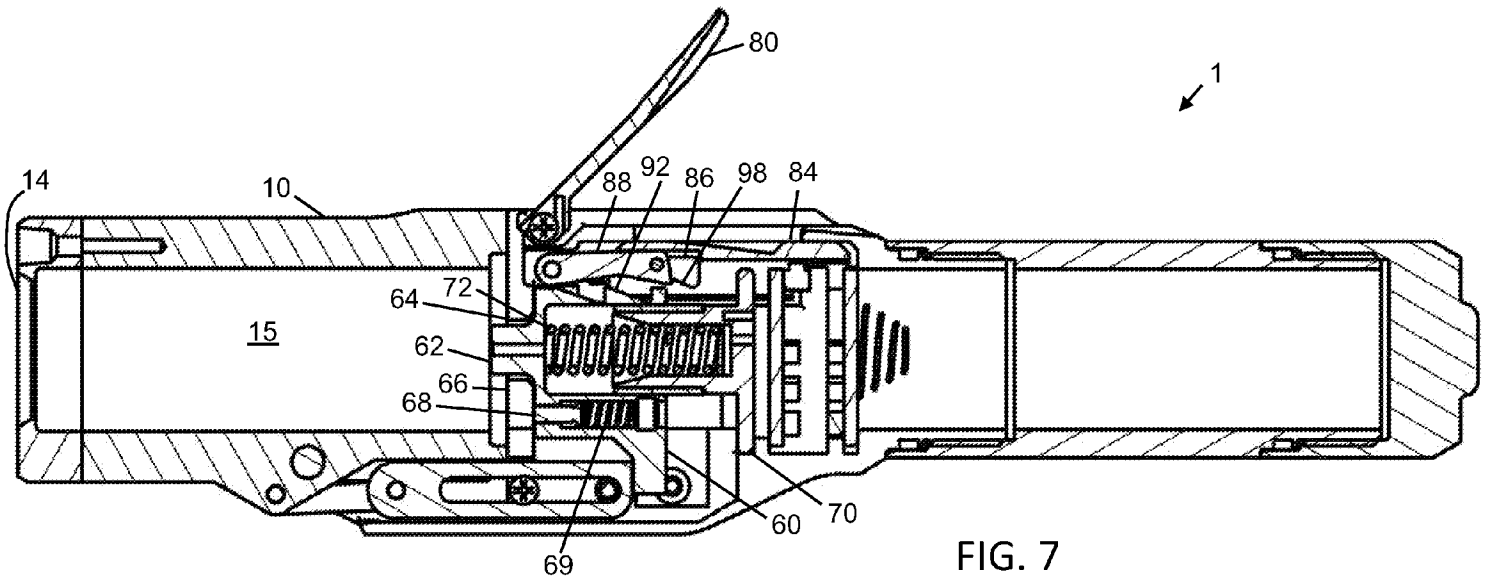
FIG. 7 is a side sectional view showing the device with the trigger position at fire and the firing pin fully actuated.

FIG. 7 shows the device 1 with the trigger 84 in the fire position and the firing pin 62 having been fully actuated. The crown 10 is closed, the safety flap 80 open, the trigger 84 with its ramp 86 are still pulled back. The pawl 88 is still forced away from the sear tooth 92 due to engagement of the guide pin 89 on the inclined surface 98 of the ramp 86. The firing spring 72 has extended to its maximum length to push the firing pin 62 through the opening 64 in the stop plate 66. The return pin 68 has been pushed into the firing pin body 60 by impact on the stop plate 66, compressing the return spring 69. When the firing pin 62 protrudes through the opening 64 into the chamber 15 it causes a cartridge in the chamber to discharge through the aperture 14.

Figure 8:
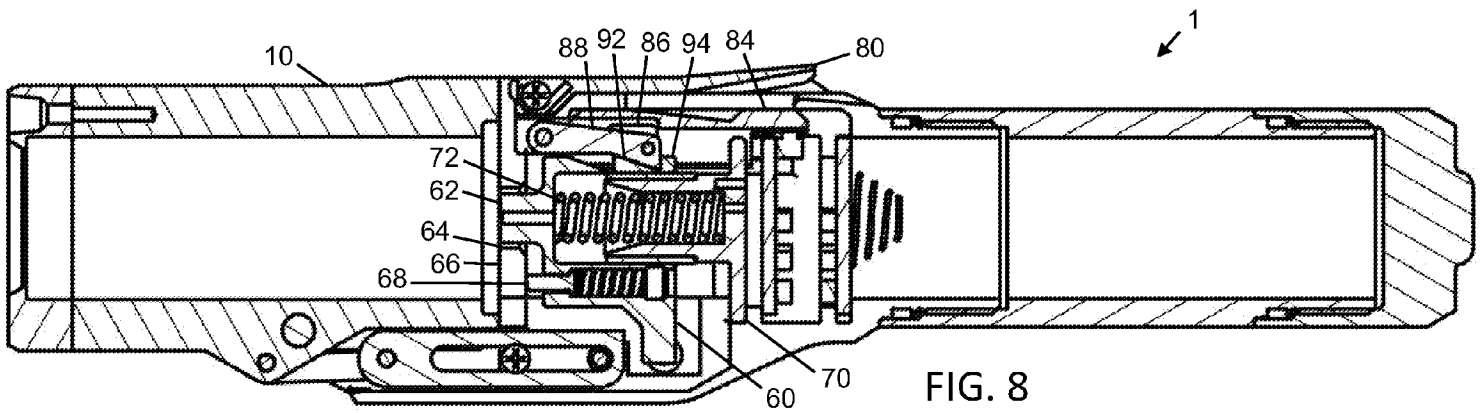
FIG. 8 is a side sectional view showing the device with the trigger position off and the firing pin un-cocked.

FIG. 8 shows the device 1 with the trigger 84 off and the firing pin 62 un-cocked. The crown 10 is closed, the safety flap 80 is closed and the trigger 84 and its ramp 86 have sprung forwards, which has allowed the pawl 88 to spring inwards onto the outer surface of the sear tooth 92. The pawl 88 is engaged with a rear sear tooth 94, which prevents forward motion of the firing pin body 60. This prevents any possibility that the firing pin 62 engages with a cartridge when the device is not cocked and the trigger 84 is in the off state. The spring 72 has been compressed slightly from its maximum extension because the return pin 68 has pushed the firing pin body 60 backwards slightly in order to retract the firing pin 62 from the chamber 15. Alternately, this can be done by making the firing spring 72 slightly shorter than the cavity in the firing pin base 70, so that the return pin 68 can return the firing pin 62 with no force opposing it from the firing pin spring. The return pin 68 is in contact with the stop plate 66. The firing pin 62 is still within the opening 64 in the stop plate 66 but does not pass through into the chamber 15. The return spring 69 is slightly compressed as it is pushing on the stop plate 66. The firing pin body 60 is pushed forwards relative to the firing pin base 70 by the spring 72.

Figure 9:
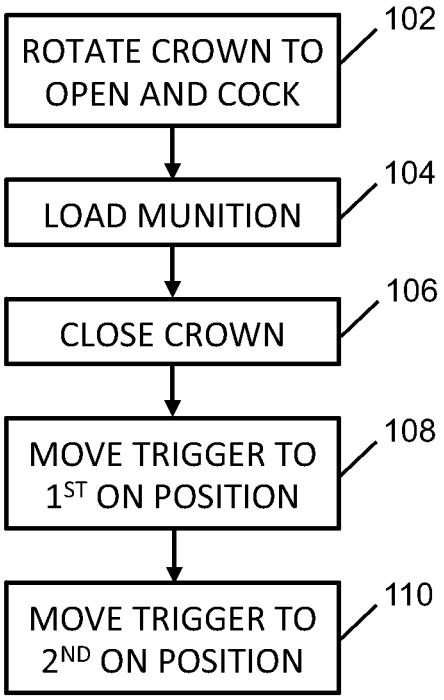
FIG. 9 is a method for deploying the device.

Referring to FIG. 9, the main steps of a method for deploying the munition deploying flashlight device 1 are shown. In step 102 the crown 10 of the device is rotated about the crown pivot 16 to an open position, in order to mechanically actuate the toggle 26, which cocks the firing pin 62. In step 104, a munition is loaded into the chamber 15 of the crown 10. In step 106, the crown 10 is rotated about the crown pivot 16 to a closed position in order to align the munition with the firing pin 62. In step 108, the trigger 84 is moved from an off position to a first on position to illuminate the strobe. Finally, in step 110 the trigger 84 is moved from the first on position to the second on position to discharge the munition in the direction in which the strobe is aimed.

The device is about the same size as a commonly used, tactical flashlight, while being capable of safely chambering and deploying many different types of munitions. Even so, other sizes are possible. The inner shape of the crown can be dimensioned to chamber munitions of varying proportions. For example, signal flares and animal deterrents are somewhat longer than 12 gauge shells. The trigger may be configured differently. For example, the trigger may have two on positions into which it can be slid, one for the strobe and the other for firing the cartridge. In each on position, the trigger may have a tactile stop. Parts described as integral may be made from separate components fixed together. Different components of the device, other than those shown, may be used. Components may be proportioned, dimensioned or shaped differently to those shown. They may also be configured to engage in different ways while still achieving the same result.

For camping and other outdoor pursuits, the user can carry just a single device, for example in a hip pouch, that serves as a flashlight but also has the capability of instantly deploying an animal deterrent round when required.

In self-defense and security applications, the device can be used to deploy a high-velocity pepper powder blast, as opposed to pepper spray, using an air or pyrotechnic powered cartridge. When fired, these non-lethal cartridges create a loud discharge, which has a disorienting effect on the recipient, as well as deploying a charge of pepper powder at a much higher velocity than an aerosol spray. Pepper powder is also inhaled easily, creating a further obstruction for the assailant. The user can also choose to load the device with a pepper ball cartridge, instead of pepper powder, which has the further advantage of imparting a kinetic impact to the assailant. These attributes help create a more effective self-defense tool.

For corrections and law enforcement, the device enables personnel to carry less-than-lethal rounds in a small device that is inexpensive compared to a shotgun and is the same size as a standard duty flashlight, and can be carried safely on any duty belt. As the device also functions as a standard, tactical light, it alleviates the user from having to carry a separate flashlight.

For SWAT and military applications, by mounting the device in place of the shotgun, the user maintains the primary function of the master key, without the penalties of added weight and reduced maneuverability. In this configuration, the rifle would absorb the recoil and shock generated by a standard 12 gauge shotgun shell.

Some embodiments of the device would only be sold to registered law enforcement and military agencies.

The foregoing is a detailed description of an illustrative and specific embodiment of the invention. However, the description itself is not intended to limit the scope of this patent. Rather, the inventor has contemplated that the claimed subject matter might also be embodied in other ways, in conjunction with other present or future technologies. Various modifications and additions can be made without departing from the scope of this invention.

The invention claimed is:

1. A munition deploying flashlight device comprising:

a body having a front portion and a rear portion;

a firing pin housed in the body;

a crown having a chamber for loading a munition therein, wherein said crown is:

attached via a pivot to the front portion of the body; and rotatable from an open position that exposes an opening in the crown through which the munition is loaded to a closed position that aligns the loaded munition with the firing pin;

a toggle that is mechanically actuated by the crown to cock the firing pin as the crown is rotated to its open position;

one or more light sources mounted in the crown; and a trigger having an off position, a first on position that causes the light sources to strobe and a second on position that causes the firing pin to discharge the munition.

2. The device of claim 1, wherein the light sources are mounted to provide illumination in a direction that the munition is discharged.

3. The device of claim 1, wherein the light sources are light emitting diodes.

4. The device of claim 1, wherein the light sources are mounted in a muzzle of the crown.

5. The device of claim 1, wherein the light sources are arranged in a ring around an aperture in the muzzle.

6. The device of claim 1, wherein the first on position and the second on position each have a tactile stop.

7. The device of claim 1, wherein the trigger is biased by a spring in the off position, the trigger slides against the spring to the first on position and slides the trigger further against the spring to the second on position.

8. The device of claim 1, further comprising a safety flap that is movable from a position that covers the trigger to a position that exposes the trigger.

9. The device of claim 1, further comprising an extendable battery compartment connected to the rear portion of the body.

10. The device of claim 1, wherein the pivot is on an opposite side of the body to the trigger.

11. The device of claim 1, wherein the crown is connected to the toggle via an arm and two further pivots so that the toggle slides forwards and backwards in the body.

12. The device of claim 11, further comprising a firing pin body onto which the firing pin is attached, wherein the toggle pushes the firing pin body backwards to cock the firing pin.

13. The device of claim 1, wherein the chamber is dimensioned to house a 12 gauge shotgun cartridge.

14. The device of claim 1, wherein the chamber is dimensioned to house a signal flare.

15. The device of claim 1, wherein the chamber is dimensioned to house an animal deterrent.

16. The device of claim 1, wherein the trigger is mounted in the body.

17. A method of deploying a munition deploying flashlight device comprising: rotating a crown of the device to an open position, to mechanically actuate a toggle to cock a firing pin of the device; loading a munition into a chamber of the crown; wherein one or more light sources are mounted in the crown; rotating the crown to a closed position to align the munition with the firing pin; moving a trigger in the device from an off position to a first on position to illuminate a strobe in the device; and moving the trigger from the first on position to a second on position to discharge the munition in a direction in which the strobe is aimed.

18. The method of claim 17, wherein moving the trigger comprises sliding it from the off position to the first on position and then from the first on position to the second on position.

* * * * *